United States Patent [19]

Nakajima et al.

[11] Patent Number: 4,850,815

[45] Date of Patent: Jul. 25, 1989

[54] VARIABLE CAPACITY VANE COMPRESSOR

[75] Inventors: Nobiyuki Nakajima; Kinichi Inomata; Shigeru Okada; Kazuo Eitai, all of Saitama, Japan

[73] Assignee: Diesel Kiki Co., Ltd., Tokyo, Japan

[21] Appl. No.: 182,481

[22] Filed: Apr. 15, 1988

[30] Foreign Application Priority Data

Sep. 25, 1987 [JP] Japan ..... 62-241554

[51] Int. Cl.[4] ..... F04B 49/02; F04C 29/08; F04C 49/08

[52] U.S. Cl. ..... 417/295; 417/310

[58] Field of Search ..... 417/295, 310

[56] References Cited

U.S. PATENT DOCUMENTS 4,744,732 5/1988 Nakajiima et al. ..... 418/15
4,776,770 10/1988 Nakajiima et al. ..... 417/295
4,7373,081 4/1988 Nakajiima et al. ..... 417/310

FOREIGN PATENT DOCUMENTS 62-129593 6/1987 Japan .

*Primary Examiner*—William L. Freeh
*Attorney, Agent, or Firm*—Frishauf, Holtz, Goodman & Woodward

[57] ABSTRACT

A vane compressor is provided with a control valve device having a deformable member disposed within a zone under low pressure for expansion and contraction in response to pressure therein. A pressure-responsive control device is associated with the control valve device for controlling the capacity of the compressor. The deformable member contracts and causes the control device to bring the compressor into full-capacity operation when the pressure within the zone under low pressure is higher than a predetermined value, whereas the deformable member expands and causes the control device to bring the compressor into partial-capacity operation when the pressure within the zone under low pressure is lower than the predetermined value. A device is provided which is operable in response to excessive expansion of the deformable member for causing the control device to bring the compressor into full-capacity operation.

12 Claims, 11 Drawing Sheets

VARIABLE CAPACITY VANE COMPRESSOR

BACKGROUND OF THE INVENTION

This invention relates to variable capacity vane compressors which are adapted for use as refrigerant compressors of air conditioners for automative vehicles.

A variable capacity vane compressor is known e.g. by Japanese Provisional Patent Publication (Kokai) No. 62-129593, which is capable of controlling the capacity of the compressor by varying the suction quantity of a gas to be compressed. According to this known vane compressor, there is provided a pressure chamber formed in one of side blocks of a cylinder accommodating a rotor and communicating a zone under lower pressure with a zone under higher pressure, and an inlet port the opening angle of which is variable in response to a difference between pressure within a first pressure chamber of the pressure chamber and pressue within a second pressure chamber of same. The first pressure chamber is communicated with the zone under lower pressure, and the second pressure chamber is selectively communicatable with the zone under higher pressure via a high-pressure communication passage and with the zone under lower pressure via a lower-pressure communication passage by means of a control valve device. The control valve device extends across the high-pressure communication passage and the low-pressure communication passage, and is adapted to close the low-pressure communication passage and similtaneously open the high-pressure communication passage when pressure within the zone under lower pressure exceeds a predetermined value, to thereby bring the compressor into full capacity operation, and to open the low-pressure communication passage and simultaneously close the high-pressure communication pasasage when the pressure within the zone under lower pressure is below the predetermined value, to thereby bring the compressor into partial capacity operation.

The above control valve device comprises a bellows disposed within the zone under lower pressure and having an internal pressure lower than the pressure outside the bellows, i.e. the pressure within the zone under lower pressure, and a valve body having its one end connected to the bellows for axial movement thereof, wherein the control valve device selectively opens and closes the low-pressure communication passage and the high-pressure communication passage through expansion and contraction thereof in response to changes in the pressure outside the bellows, i.e. the pressure within the zone under lower pressure.

However, according to such conventional vane compressor, if the bellows is broken, e.g owing to a pinhole or the like formed through the peripheral wall thereof and hence the inside and outside of the bellows are brought into communication with each other, the internal pressure of the bellows increases to cause the bellows to expand abnormally. Consequently, the control valve device continues to open the low-pressure communication passage, so that the compressor continues partial capacity operation, thus failing to exhibit required compression ability.

SUMMARY OF THE INVENTION

It is the object of the invention to provide a variable capacity vane compressor which can exhibit required compression ability even when the bellows of the control valve device is broken and hence the inside and outside of the bellows are brought into communication with each other.

According to the present invention, there is provided a vane compressor given in [claim 1].

The above and other objects, features and advantages of the invention will be more apparent from the ensuing detailed description taken in conjunction with the accompanying drawings.

DETAILED DESCRIPTION

The invention will now be described in detail with reference to the drawings showing embodiments thereof.

Figure 1:
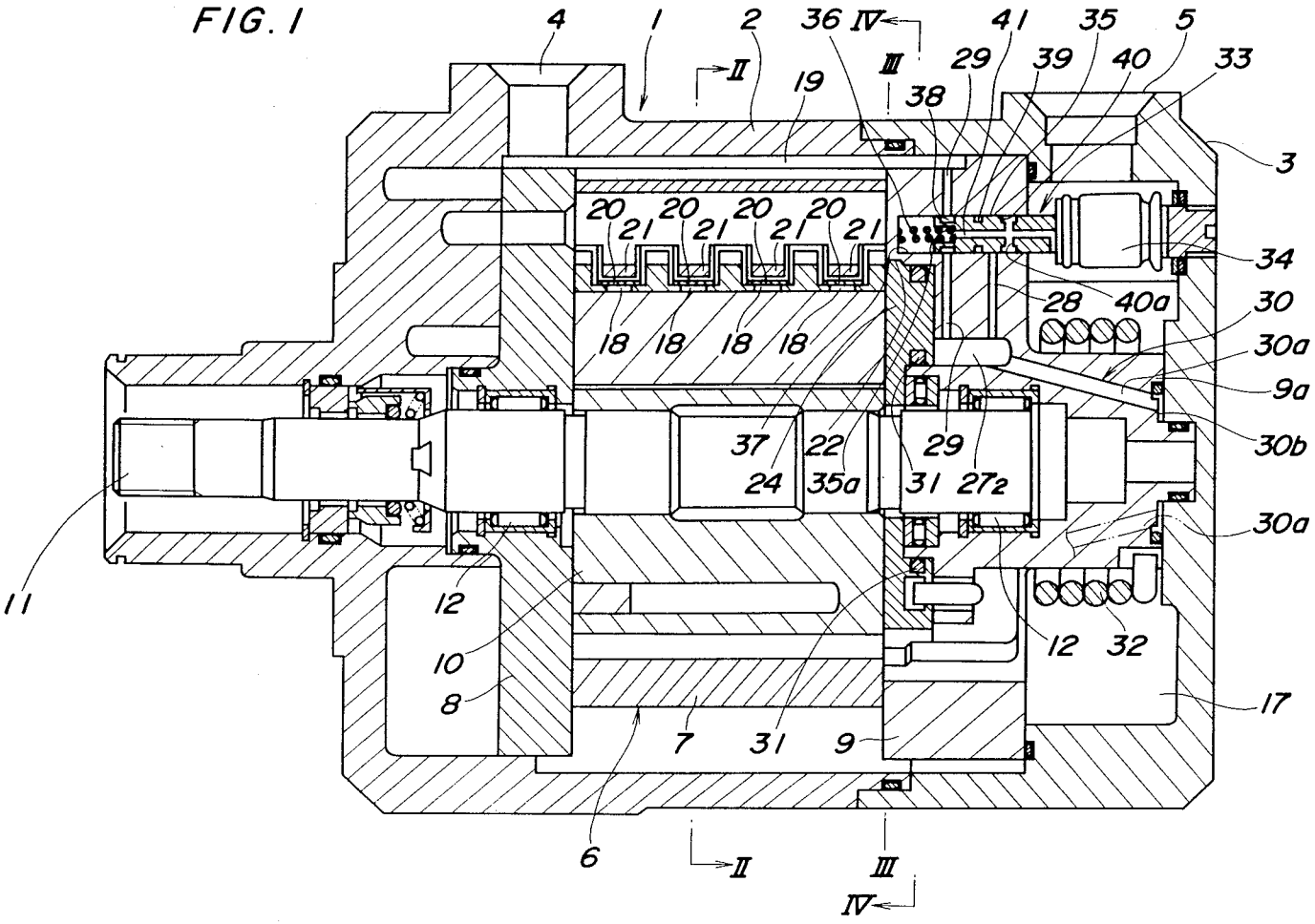
FIG. 1 is a longitudinal sectional view of a variable capacity vane compressor according to a first embodiment of the invention.

FIGS. 1 through 7 show a variable capacity vane compressor according to a first embodiment of the invention. Referring first to FIG. 1, reference numeral 1 represents a housing which comprises a cylindrical casing 2 with an open end, and a rear head 3, which is fastened to the casing 2 by means of bolts, not shown, in a manner closing the open end of the casing 2. A discharge port 4, through which a refrigerant gas as a thermal medium is to be discharged, is formed in an upper wall of the casing 2 at a front end thereof, and a suction port 5, through which the refrigerant gas is to be drawn into the compressor, is formed in an upper portion of the rear head 3. The discharge port 4 and the suction port 5 communicate, respectively, with a discharge pressure chamber and a suction chamber, both hereinafter referred to.

A pump body 6 is housed within the housing 1. The pump body 6 is composed mainly of a cylinder formed by a cam ring 7, and a front side block 8 and a rear side block 9 closing open opposite ends of the cam ring 7, a cylindrical rotor 10 rotatably received within the cylinder, and a driving shaft 11 which is connected to an engine, not shown, of a vehicle or the like, and on which is secured the rotor 10. The driving shaft 11 is rotatably supported by a pair of radial bearings 12 and 12 provided in the side blocks 8 and 9, respectively.

Figure 2:
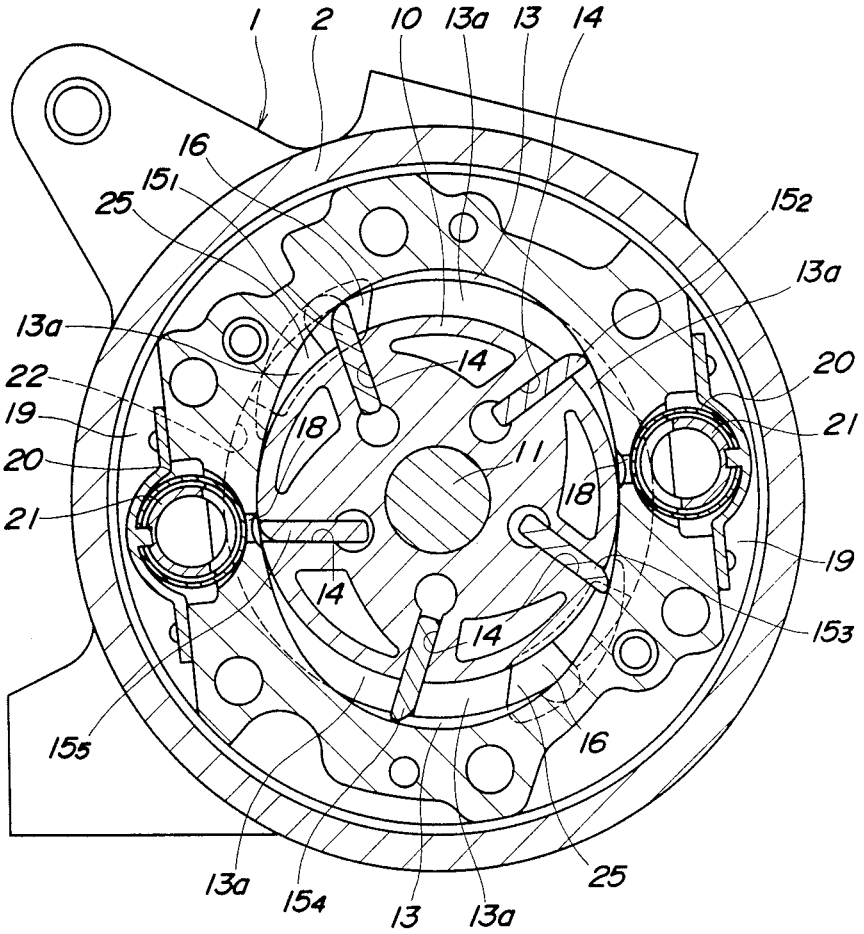
FIG. 2 is a transverse sectional view taken along line II—II in FIG. 1.

The cam ring 7 has an inner peripheral surface with an elliptical cross section, as shown in FIG. 2, and cooperates with the rotor 10 and the side blocks 8 and 9 to define therebetween a pair of compression spaces 13 and 13 at diametrically opposite locations.

The rotor 10 has its outer peripheral surface formed with a plurality of (five in the illustrated embodiment) axial vane slits 14 at circumferentially equal intervals, in each of which a vane $15_1$–$15_5$ is radially slidably fitted. Adjacent vanes $15_1$–$15_5$ define therebetween five compression chambers 13*a* in cooperation with the cam ring 7, the rotor 10, and the opposite inner end faces of the front and rear side blocks 8, 9.

Figure 3:
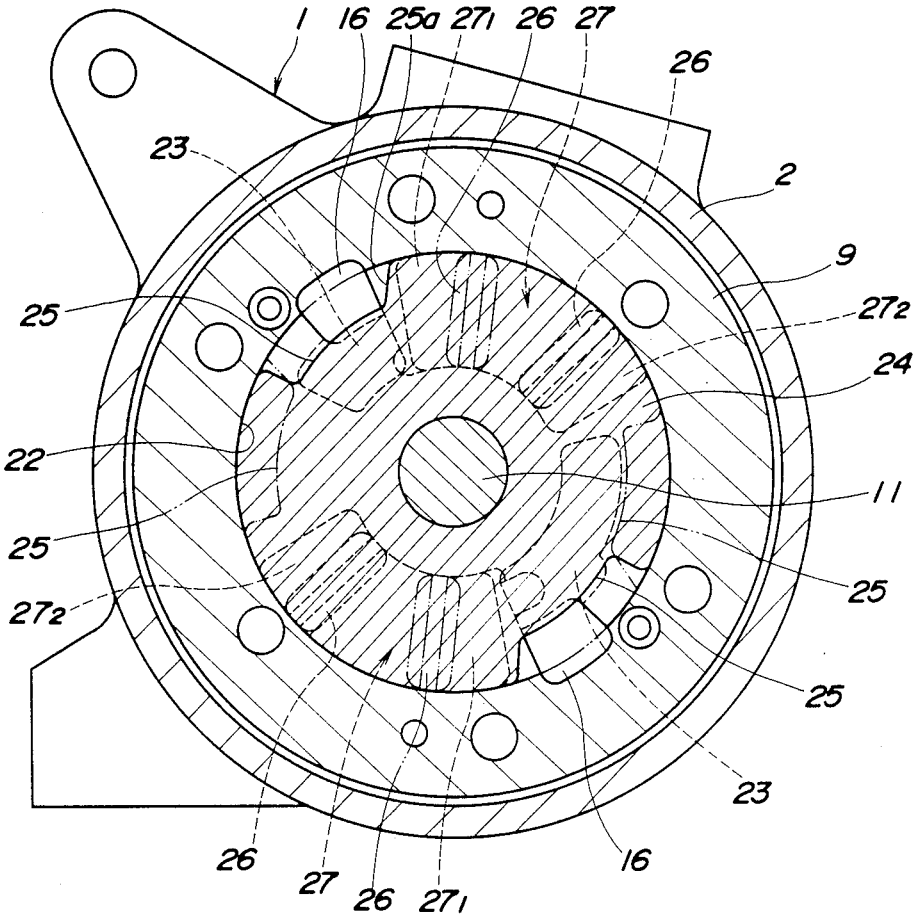
FIG. 3 is a transverse sectional view taken along line III—III in FIG. 1.

Inlet ports 16 and 16 are formed in the rear side block 9 at diametrically opposite locations, as shown in FIGS. 2 and 3. These inlet ports 16, 16 are located at such locations that they become closed when the respective compression chambers 13*a* assume the maximum volume. These inlet ports 16, 16 axially extend through the rear side block 9 and through which the suction chamber (zone under lower pressure) 17 defined in the rear head 3 by the rear side block 9 and the compression chamber 13*a* on the suction stroke are communicated with each other.

Two groups of outlet ports 18, each group consisting of four outlet ports, are formed through the peripheral wall of the cam ring 7 at diametrically opposite locations and through which the compression chambers 13 on the compression stroke are communicated with the discharge pressure chamber (zone under higher pressure) 19 defined between the inner peripheral surface of the casing 2 and the outer peripheral surface of the cam ring 7, as shown in FIGS. 1 and 2. These outlets ports 18 are provided with respective discharge valves 20 and valve retainers 21, as best shown in FIG. 2.

Figure 4:
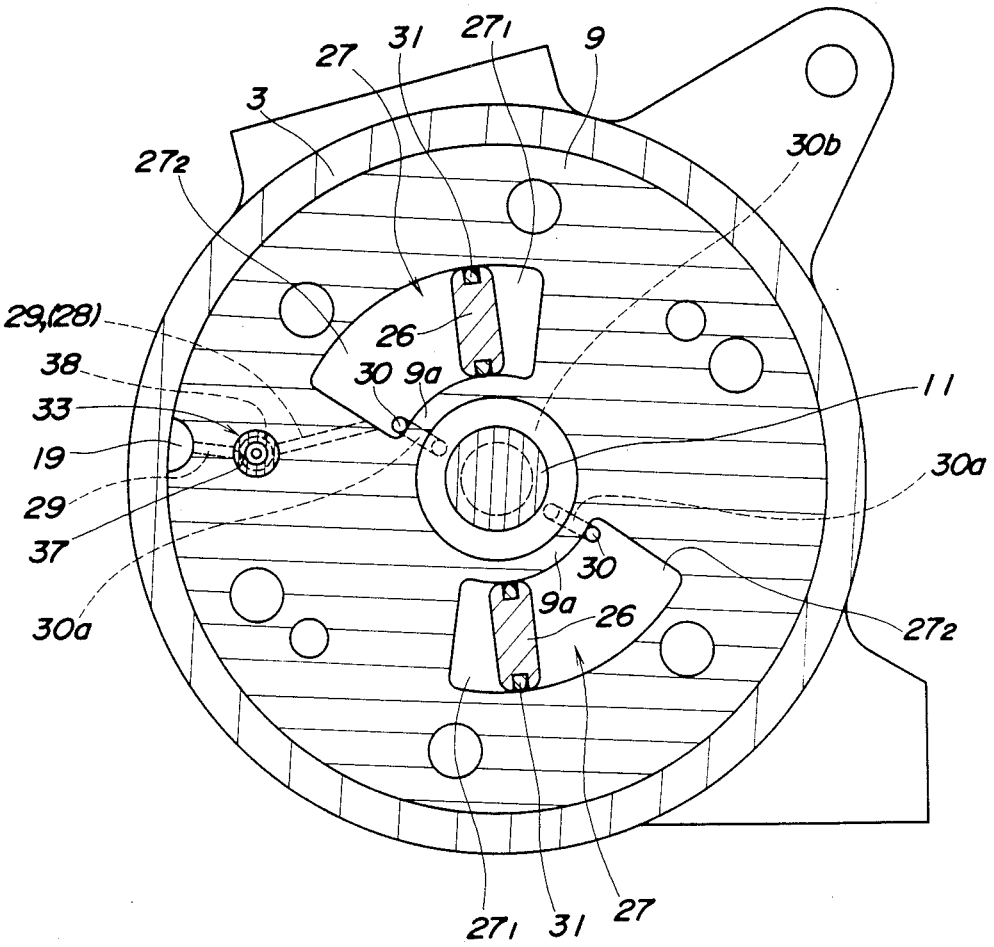
FIG. 4 is a transverse sectional view taken along line IV—IV in FIG. 1.
Figure 5:
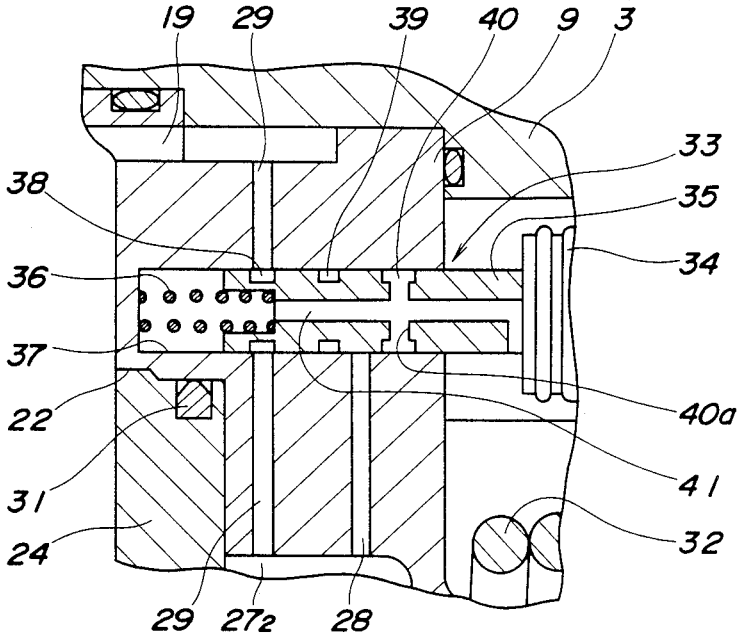
FIG. 5 is an enlarged longitudinal sectional view of a control valve device in FIG. 1 in a position assumed when the compressor is at full capacity operation.

The rear side block 9 has an end face facing the rotor 10, in which is formed an annular recess 22 larger in diameter then the rotor 10, as shown in FIGS. 3 and 5. A pair of second inlet ports 23 and 23 in the form of arcuate openings are formed through a bottom of the recess 22 at diametrically opposite locations and circumferentially extend continuously with the respective inlet ports 16, 16, as best shown in FIG. 3. The suction chamber 17 is communicated with the compression chamber 13 on the suction stroke through the inlet ports 16 and 23. An annular control element 24 is received in the annual recess 22 for angular movement about the axis of the rotor shaft 11 in opposite circumferential directions to control the opening angle of the second inlet ports 23, 23. The control element 24 has its outer peripheral edge formed with a pair of diametrically opposite arcuate cut-out portions 25 and 25, and its one side surface formed integrally with a pair of pressure-receiving portions 26 and 26 axially projected therefrom in diametrically opposite relation to each other. The pressure-receiving portions 26, 26 are slidably received in respective arcuate spaces 27 and 27 which are formed in the rear side block 9 in a manner continuous with the annular recess 22 and circumferentially partially overlapping with the respective second inlet ports 23, 23. The interior of each of the arcuate spaces 27, 27 is divided into first and second pressure chambers $27_1$ and $27_2$ by the associated pressure-receiving portions 26. The first pressure chamber $27_1$ communicates with the suction chamber 17 through the corresponding inlet port 16 and the corresponding second inlet port 23, and the second pressure chamber $27_2$ communicates with the suction chamber 17 and the discharge pressure chamber 19, respectively, through a low-pressure communication passage 28 and a high-pressure communication passage 29 formed in the rear side block 9, as shown in FIG. 5. The two chambers $27_2$, $27_2$ are communicated with each other by way of a communication passage 30. The communication passage 30 comprises a pair of communication channels 30*a*, 30*a* formed in a boss 9*a* projected from a central portion of the rear side block 9 at a side remote from the rotor 10, and an annular space 30*b* defined between a projected end face of the boss 9*a* and an inner end face of the rear head 3, as shown in FIGS. 1 and 4. The communication passages 30*a*, 30*a* are arranged symmetrically with respect to the center of the boss 9*a*. Respective ends of the communication passages 30*a*, 30*a* are communicated with the respective second pressure chambers $27_2$, $27_2$, and the other respective ends are communicated with the annular space 30*b*.

A sealing member 31 of a special configuration is mounted in the control element 24 and disposed along an outer peripheral surface thereof and radially opposite faces of each pressure-receiving protuberance 26, to seal in an airtight manner between the first and second pressure chambers $27_1$ and $27_2$, as shown in FIG. 4, as well as between the outer peripheral surfaces of the control element 24 and the inner peripheral surface of the annular recess 22 of the rear side block 9, as shown in FIG. 5.

The control element 24 is elastically urged in such a circumferential direction as to increase the opening angle of the second inlet ports 23, i.e. in the clockwise direction as viewed in FIG. 3, by a coiled spring 32 fitted around a central boss 9*a* of the front side block 9 axially extending toward the suction chamber 17, with its one end engaged by the central boss 9*a* and the other end by the control element 24, respectively.

Arranged across the low-pressure and the high-pressure communication passages 28, 29 is a control valve device 33 for selectively closing and opening them, as shown e.g. in FIG. 5. The control valve device 33 is operable in response to pressure within the suction chamber 17, and it comprises a flexible bellows 34 disposed in the suction chamber 17, with its axis extending parallel with that of the driving shaft 11, a spool valve body 35, and a coiled spring 36 urging the spool valve body 35 in its closing direction. The bellows 34 has a hermetically sealed interior with its internal pressure set at a value lower than the external pressure within the suction chamber 17, e.g., at vacuum. The bellows 34 has a coiled spring, not shown, incorporated therein to cause axial expansion and contraction of the bellows 34 in response to pressure difference between the internal pressure and the external pressure within the suction chamber 17. The bellows 34 assumes a normal axial length at a predetermined external pressure, e.g., 2 atm., outside the bellows 34 or within the suction chamber 17, contracts at an external pressure higher than the predetermined value, and expands at an external pressure lower than the predetermined value. The spool valve body 35 is slidably received within a valve bore 37 formed in the rear side block 9 in a manner extending across the low-pressure communication passage 28 and the high-pressure communication passage 29. The spool valve body 35 has a first annular groove 38, a second annular groove 39, and a third annular groove 40 formed on the outer peripheral surface thereof at predetermined intervals, and an axial passage 41 formed therein along its axis. The third annular groove 40 closer to the bellows 34 communicates with the axial passage 41 via radial communication passages 40*a*. The coiled spring 36 is interposed between a seating bottom surface 35*a* of a recess formed in an end face of the spool valve body 35 remote from the bellows 34 and an opposed end face of the valve bore 37 and urges the spool valve body 35 against an opposed end face of the bellows 34.

With this arrangement, when the pressure within the suction chamber 17 is higher than the predetermined value and accordingly the bellows 34 is in a contracted state, the spool valve body 35 assumes a position in which the high-pressure communication passage 29 is aligned with the first annular groove 38 and at the same time the low-pressue communication passage 28 is blocked by the peripheral wall of the spool valve body 35. When the pressure within the suction chamber 17 is lower than the predetermined value and hence the bellows 34 is in an expanded state, the spool valve body 35 assumes a position in which the high-pressure communication passage 29 is out of alignment with the first annular groove 38 and hence blocked by the outer peripheral wall of the spool value body 35 and at the same time the low-pressure communication passage 28 is aligned with the third annular groove 40 of the spool valve body 35 to open the low-pressure communication passage 28.

Figure 7:
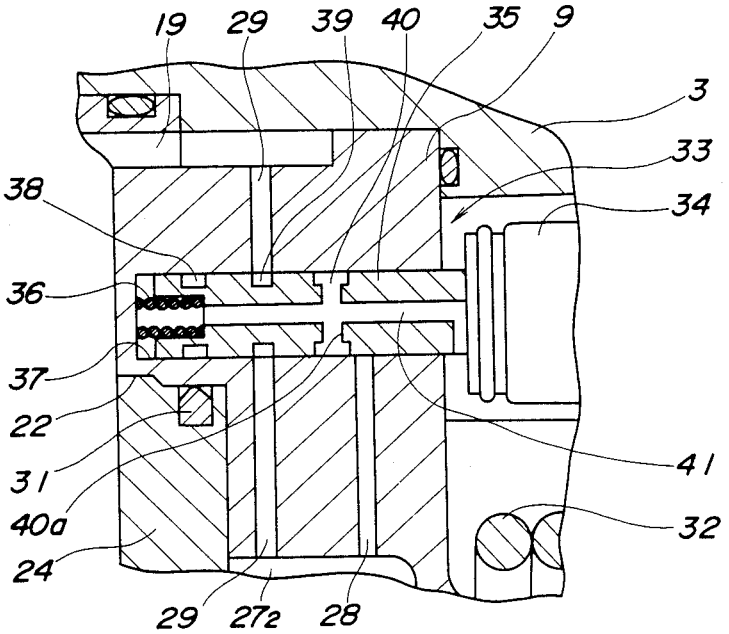
FIG. 7 is a view similar to FIG. 5, wherein a bellows of the control valve device in FIG. 1 is injured and the inside and outside of the bellows are in communication with each other.

On the other hand, if the bellows 34 is injured due to formation of pinholes in the peripheral wall thereof or the like and the inside and outside of the bellows 34 are brought into communication with each other, the bellows 34 is expanded to its maximum length, irrespective of the pressure within the suction chamber 17, due to the increased internal pressure and the force of the coiled spring incorporated therein, thereby displacing the spool valve body 35 to an extreme position remote from the bellows 34, as shown in FIG. 7. Consequently, the second annular groove 39 of the spool valve body 35 becomes aligned with the high-pressure communication passage 29, and at the same time the low-pressure passage 28 is blocked by the peripheral wall of the spool valve body 35. Thus, the second annular groove 39 serves as means for bringing the compressor into full capacity operation by communicating the second pressure chamber $27_2$ with the discharge pressure chamber 19 through the high-pressure communication passage 29, in the event of breakage of the bellows 34 wherein the inside and outside of the bellows 34 are brought into communication with each other.

The operation of the compressor according to the first embodiment of invention will now be explained.

As the driving shaft 11 is rotatively driven by a prime mover such as an automotive engine to cause clockwise rotation of the rotor 10 as viewed in FIG. 2, the rotor 10 rotates so that the vanes $15_1$–$15_5$ successively move radially out of the respective slits 14 due to a centrifugal force and back pressure acting upon the vanes and revolve together with the rotating rotor 10, with their tips in sliding contact with the inner peripheral surface of the cam ring 7. During the suction stroke the compression chamber 13*a* defined by adjacent vanes increases in volume so that refrigerant gas as thermal medium is drawn through the inlet port 16 and second inlet port 23 into the compression chamber 13*a;* during the following compression stroke the compression chamber 13*a* decreases in volume to cause the drawn refrigerant gas to be compressed; and during the discharge stroke at the end of the compression stroke the high pressure of the compressed gas forces the discharge valve 20 to open to allow the compressed refrigerant gas to be discharged through the outlet port 18 into the discharge pressure chamber 19 and then discharged through the discharge port 4 into a heat exchange circuit of an associated air conditioning system, not shown.

During the operation of the compressor described above, low pressure or suction pressure within the suction chamber 17 is introduced into the first pressure chamber $27_1$ of each space 27 through the inlet port 16 and second inlet port 23, whereas high pressure or discharge pressure within the discharge pressure chamber 19 is introduced into the second pressure chamber $27_2$ of each space 27 through the high-pressure communication passage 29, depending upon the position of the control valve device 33. The control element 24 is circumferentially displaced in response to the difference between the sum of the pressure within the first pressure chamber $27_1$ and the biasing force of the coiled spring 32 (which acts upon the control element 24 in the direction of the opening angle of each second inlet port 23 being increased, i.e. in the clockwise direction as viewed in FIG. 3) and the pressure within the second pressure chamber $27_2$ (which acts upon the control element 24 in the direction in which the above opening angle is decreased, i.e. in the counter-clockwise direction as viewed in FIG. 3), to vary the opening angle of each second inlet port 23 and accordingly vary the timing of commencement of the compression stroke and hence the delivery quantity. When the above difference becomes zero, that is, when the sum of the pressure within the first pressure chamber $27_1$ and the biasing force of the spring 32 becomes balanced with the pressure within the second pressure chamber $27_2$, the circumferential displacement of the control element 24 ceases.

For instance, when the compressor is operating at a low speed, the refrigerant gas pressure or suction pressure within the suction chamber 17 is so high that the bellows 34 of the control valve device 33 is contracted to bias the spool valve body 35 to align the first annular groove 38 with the high-pressure communication passage 29 and hence communucate therebetween and simultaneously block the low-pressure communication passage 28 by the outer peripheral surface of the spool valve body 35, as shown in FIG. 5. Accordingly, the pressure within the discharge pressure chamber 19 is introduced into the second pressure chamber $27_2$. Thus, the pressure within the second pressure chamber $27_2$ surpasses the sum of the pressure within the first pressure chamber $27_1$ and the biasing force of the coiled spring 32 so that the control element 24 is circumferentially displaced into an extreme position in the counter-clockwise direction as viewed in FIG. 3, whereby the second inlet port 23, is fully closed by the control element 24 with its cut-out portion 25 out of alignment with the port 23, as indicated by the two-dot chain lines in FIG. 3 (the opening angle is zero). With the control element 24 in the two-dot chain position, the refrigerant gas starts to be compressed when a trailing one of two adjacent vanes defining each compression chamber 13*a* reaches a leading edge 25*a* of the corresponding cut-out 25 of the control element 24, so that the compression start timing advances. Consequently, all the refrigerant gas drawn through the inlet port 16 into the compression chamber 13*a* on the suction stroke is compressed and discharged, resulting in the maximum delivery quantity (Full Capacity Operation).

Figure 6:
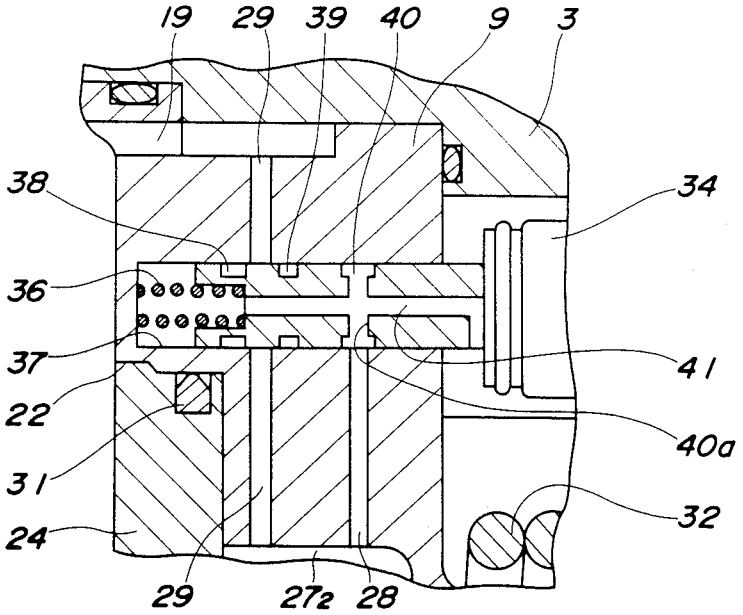
FIG. 6 is a view similar to FIG. 5, wherein the compressor in FIG. 1 is at partial capacity operation.

On the other hand, when the compressor is brought into high-speed operation, the suction pressure within the suction chamber 17 decreases so that the bellows 34 of the control valve 33 is expanded to bias the spool valve body 35 agains the force of the spring 36, i.e., the leftward direction as viewed in FIG. 1, to align the third annular groove 40 with the low-pressure communication passage 28 and simultaneously block the high-pressure communication passage 29 by the outer peripheral surface of the spool valve body 35, as shown in FIG. 6. Accordingly, the pressure within the discharge pressure chamber 19 is not introduced into the second pressure chamber $27_2$, and at the same time the pressure within the second pressure chamber $27_2$ leaks through the low-pressure communication passage 28 into the suction chamber 17 in which low or suction pressure prevails to cause a prompt drop in the pressure within the second pressure chamber $27_2$. As a result, the control element 24 is promptly angularly or circumferentially displaced in the clockwise direction as viewed in FIG. 3 toward a position as indicated by the solid line in FIG. 3. Accordingly, the refrigerant gas starts to be compressed when a trailing one of two adjacent vanes defining each compression chamber 13*a* reaches a leading edge 25*a* of the cut-out 25. Therefore, the timing of commencement of the compression stroke is retarded by an amount corresponding to the degree of opening of the second inlet ports 23, 23, resulting in a reduced amount of refrigerant gas that is compressed and hence a reduced delivery quantity (Partial Capacity Operation).

On the other hand, if the bellows 34 becomes so defective that the inside and outside of the bellows 24 become communicated with each other, the bellows 34 is expanded to its maximum length by its increased internal pressure as well as by the force of the coiled spring contained therein, thereby aligning only the second annular groove 39 with the high-pressure communication passage 29 to open the same passage 29, as shown in FIG. 7. Accordingly, the presence within the discharge pressure chamber 19 is supplied to the second chamber $27_2$ through the high-pressure communication passage 29 and the second annular groove 39 so that the control element 24 assumes an angular position in which the second inlet ports 23 are fully closed, thus resulting in the maximum delivery quantity of the compressor (Full Capacity Operation). Therefore, even if the bellows 34 becomes defective and the inside and outside thereof are brought into communication with each other, the compressor can continue to operate while exhibiting required compression ability.

Although in the first embodiment described above, the second annular groove 39 of the spool valve body 35 constitutes means for bringing the compressor into full capacity operation when the bellows 34 is injured, this is not limitative to the invention.

Figure 8:
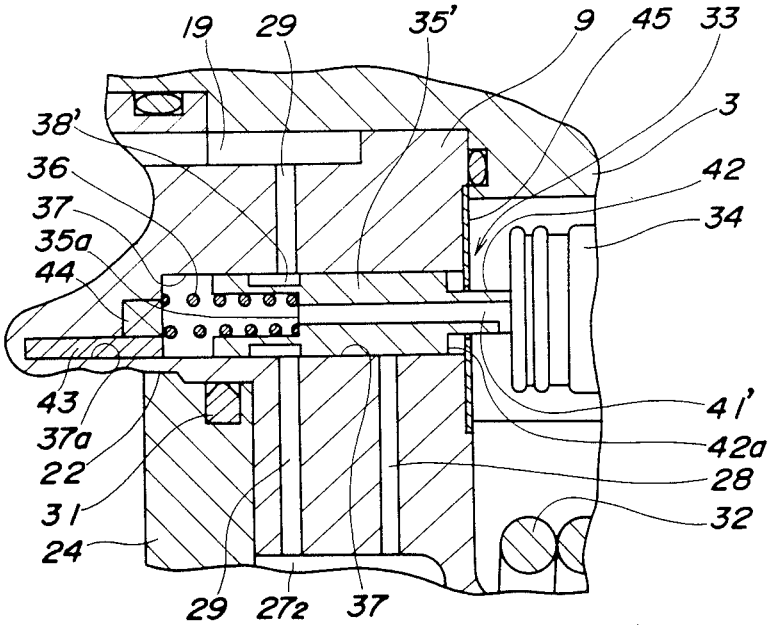
FIG. 8 is a view similar to FIG. 5 according to a second embodiment of the invention, wherein the compressor is at full capacity operation.
Figure 9:
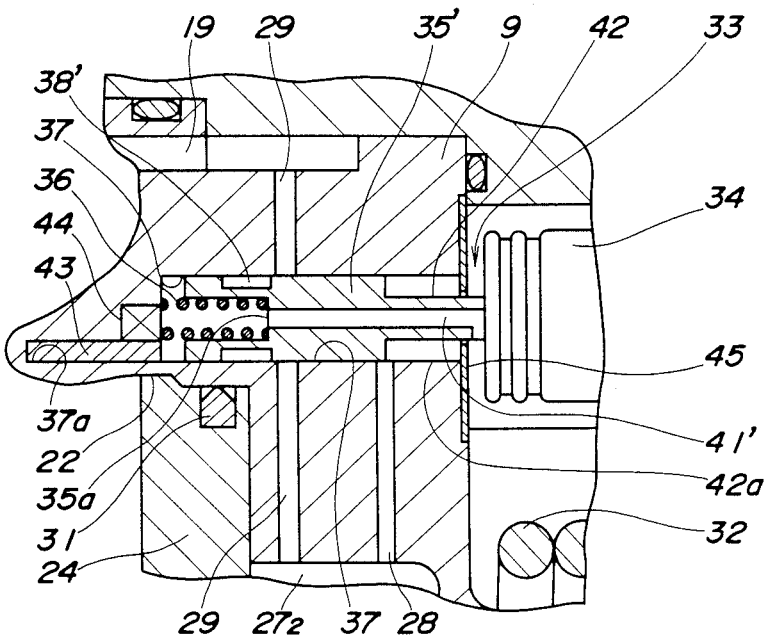
FIG. 9 is a view similar to FIG. 5, wherein the compressor in FIG. 8 is at partial capacity operation.
Figure 10:
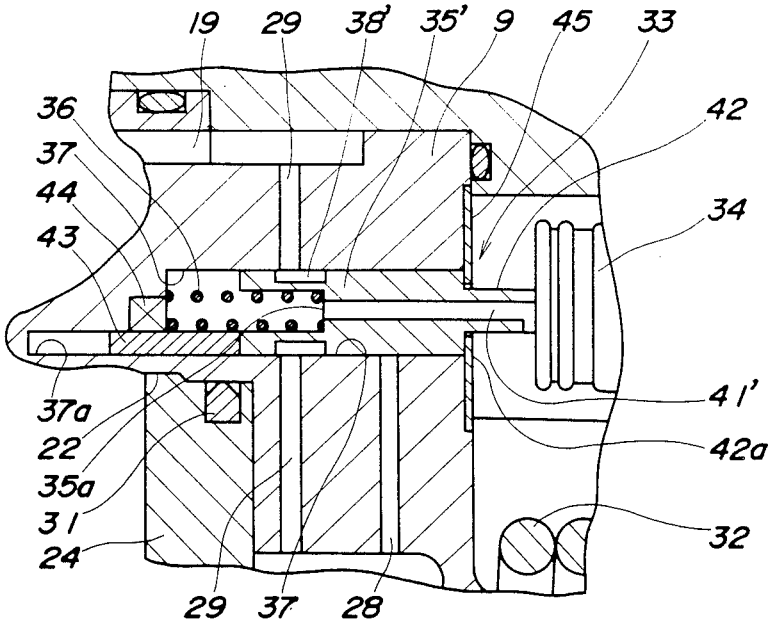
FIG. 10 is a view similar to FIG. 5, wherein the bellows of the compressor in FIG. 8 is injured and the inside and outside thereof are in communication with each other.
Figure 11:
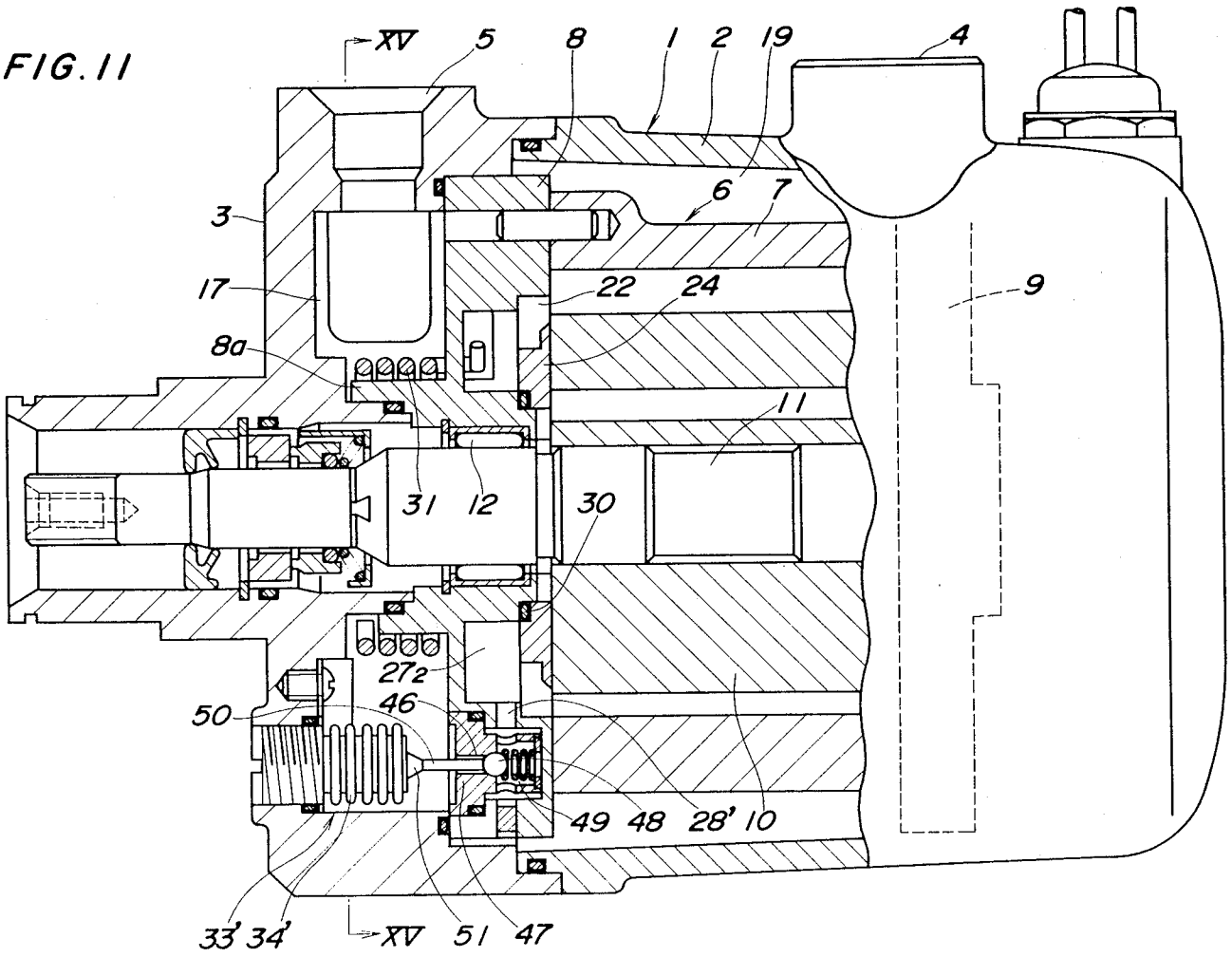
FIG. 11 is a longitudinal sectional view of a variable capacity vane compressor according to a third embodiment of the invention.

FIGS. 8 through 10 show a second embodiment of the invention. The second embodiment is distinguished from the first embodiment described above in that the means for bringing the compressor into full capacity operation is constituted by a rod 43 driven by an electric motor 44 or the like.

In FIGS. 8 through 10, corresponding or similar elements or parts to those in FIGS. 1 through 7 are designated by identical reference numerals, and detailed description thereof is omitted.

According to the second embodiment, the spool valve body 35' comprises a single annular groove 38', an axial passage 41', and a reduced-diameter portion 42, as similar to the prior art spool valve body, but a rod 43 is arranged in a bore 37*a* formed in a bottom face of the valve bore 37 and engages with an electric motor 44, by rack and pinion means, not shown, for example, so that the rod 43 can axially slidably move into and out of the bore 37*a* in response to normal and reverse rotation of the electric motor 44.

When the bellows 34 is in a normal state, the rod 43 is kept in a retracted position by the electric motor 44, in which no portion of the rod 43 is projected into the valve bore 37, as shown in FIGS. 8 and 9.

With such arrangement, when the pressure within the suction pressure chamber 17 is higher than a predetermined value, the bellows 34 is contracted and accordingly the valve body 35' is displaced toward the bellows 34 to thereby align the annular groove 38' with the high-pressure passage 29 to open the same passage 29 and at the same time block and low-pressure passage 28 by the outer peripheral surface of the spool valve body 35'. As a result, the pressure within the discharge pressure chamber 19 is supplied to the second pressure chamber $27_2$ through the high-pressure communication passage 29 and the groove 38' aligned therewith, thereby resulting in full closing of the second inlet ports 23 and hence the maximum delivery quantity (Full Capacity Operation).

When the pressure within the suction pressure chamber 17 is lower than the predetermined value, the bellows 34 expands and hence move the spool valve body 35' toward the spring 36 against its force so that a space defined by the reduced-diameter portion 42 of the spool valve body 35' overlaps with the low-pressure communication passage 28 to open the same and at the same time the high-pressure passage 29 is blocked by the outer peripheral surface of the spool valve body 35'. Consequently, the pressure within the second chamber $27_2$ leaks into the low pressure chamber 17 through the passage 28 and the space defined by the reduced-diameter portion 42, thus resulting in opening of the second inlet ports 23 and hence a reduced delivery quantity (Partial Capacity Operation).

On the other hand, if the bellows 34 becomes defective and the inside and outside thereof are brought into communication with each other, a detection switch, not shown, detects abnormal expansion of the bellows 34 and energizes the electric motor 44. Then, the rod 43 is moved into the valve bore 37 by rotation of the energized electric motor 44 and accordingly the valve body 35' is moved by the rod 43 to an extreme position toward the bellows 34 so that the annular groove 38' is aligned with the high-pressure communication passage 29 and at the same time the low-pressure communication passage 28 is blocked by the outer peripheral surface of the spool valve body 35', as shown in FIG. 10. Accordingly, the pressure within the discharge pressure chamber 19 is supplied to the second chamber $27_2$ through the passages 29 and the annular groove 38' aligned therewith, thus resulting in closing of the second inlet ports 23 and hence a maximum delivery quantity (Full Capacity Operation). In the above extreme position, the spool valve body 35' is abutted against a stopper wall 45 secured to an end face of the rear side block 9 remote from the rotor 10 at a stepped portion 42*a* formed between the large-diameter portion and the reduced-diameter portion 42 of the spool valve body 35', the detection switch detects the abutment of the spool valve body against the stopper wall 45 and terminates the energization of the electric motor 44 to hold the spool valve body 35' in the extreme position closest to the bellows 34.

In the first and second embodiments described above, the control valve 33 comprises a spool valve body, but the present invention is not limited to such arrangement.

FIGS. 11 through 15 show a third embodiment of the invention. The third embodiment is distinguished from the first and second embodiments in that the control valve 33 comprises a ball valve.

In FIGS. 11 through 15, corresponding or similar elements or parts to those in FIGS. 1 through 7 are designated by identical reference numerals, and detailed description thereof is omitted.

The control valve device 33' according to the third embodiment of the invention comprises a bellows 34' arranged in the suction chamber 17, a valve casing 47 having a communication passage 46 axially formed therethrough for communicating between the suction chamber 17 and the second pressure chamber $27_2$, a ball valve body 48 for opening and closing the communication passage 46 at an end toward the rotor 10, a valve rod 50 slidably received within the communication passage 46 and having one end abutting against the ball valve body 48 and another end formed integrally with a tapered closing portion 51 connected to the bellows 34', and a coiled spring 49 urging the ball valve body 48 in its closing direction. The first pressure chamber $27_1$ is supplied with suction pressure Ps from the suction chamber 17 through the inlet ports 16, 23, and the second chamber $27_2$ is supplied with discharge pressure Pd from the discharge pressure chamber 19 through the high pressure-communication passage 29' with a restriction, or the communication passages 29' and 30.

With the above arrangement of the control valve device 33', if the bellows 34' is in a normal state, when the pressure within the suction chamber 17 is higher than a predetermined value, the bellows 34' contracts so that the ball valve body 48 is acted upon by the force of the coiled spring 49 to close the communication passage 46. Therefore, the pressure within the second chamber $27_2$ does not leak into the suction chamber 17 through the communication passage 46 and hence surpasses the sum of the pressure within the first pressure chamber $27_1$ and the urging force of the coiled spring 31 so that the control element 24 assumes a position of fully closing the second inlet ports 23 (the opening angle is zero), thus resulting is a maximum delivery quantity of the compressor (Full Capacity Operation).

Figure 13:
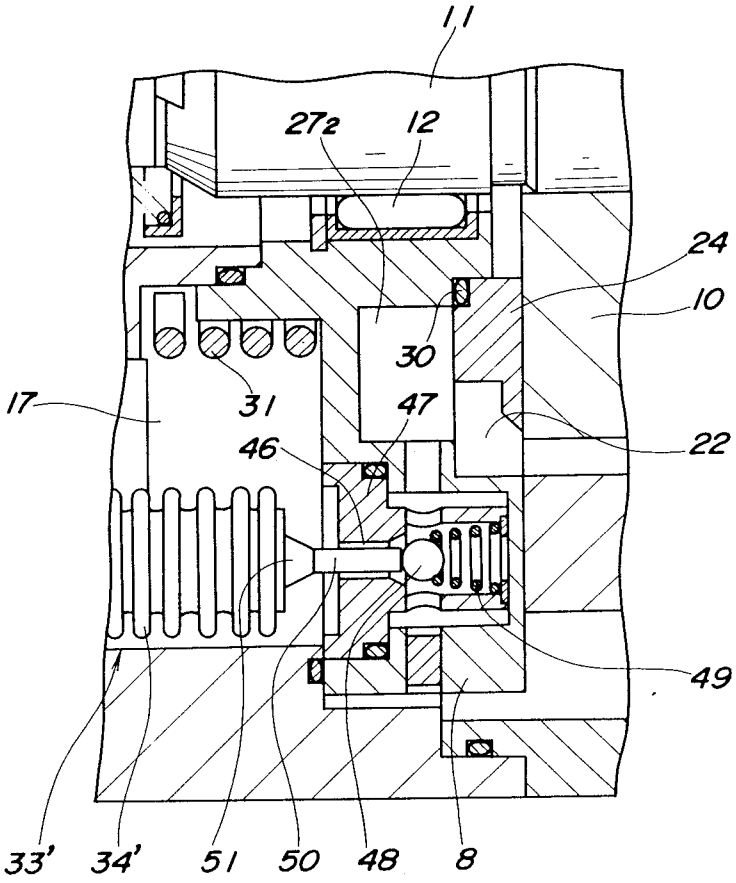
FIG. 13 is a view similar to FIG. 12, wherein the compressor in FIG. 11 is at partial capacity operation.
Figure 12:
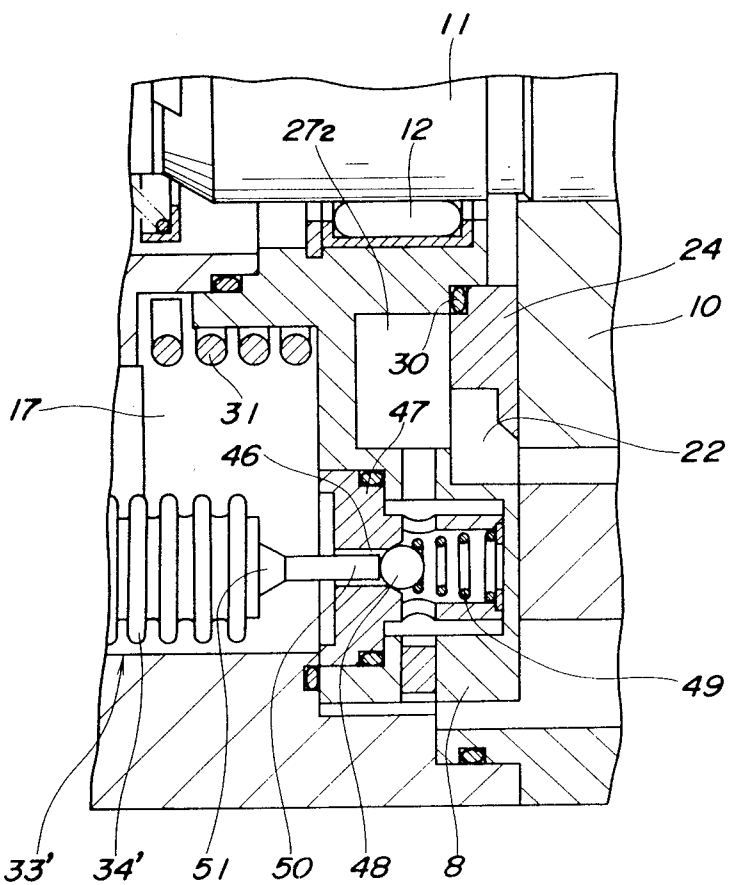
FIG. 12 is an enlarged longitudinal sectional view of a valve control device in FIG. 11 in a position assumed when the compressor is at full capacity operation.
Figure 14:
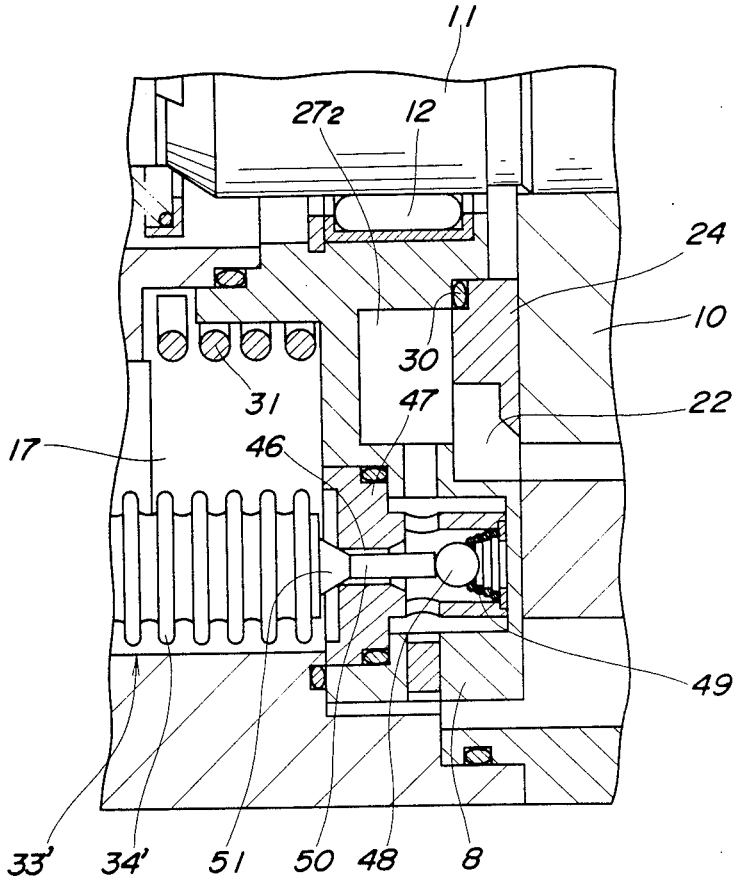
FIG. 14 is a view similar to FIG. 12, wherein the bellows of the control valve drive in FIG. 11 is injured and the inside and outside thereof are in communication with each other.
Figure 15:
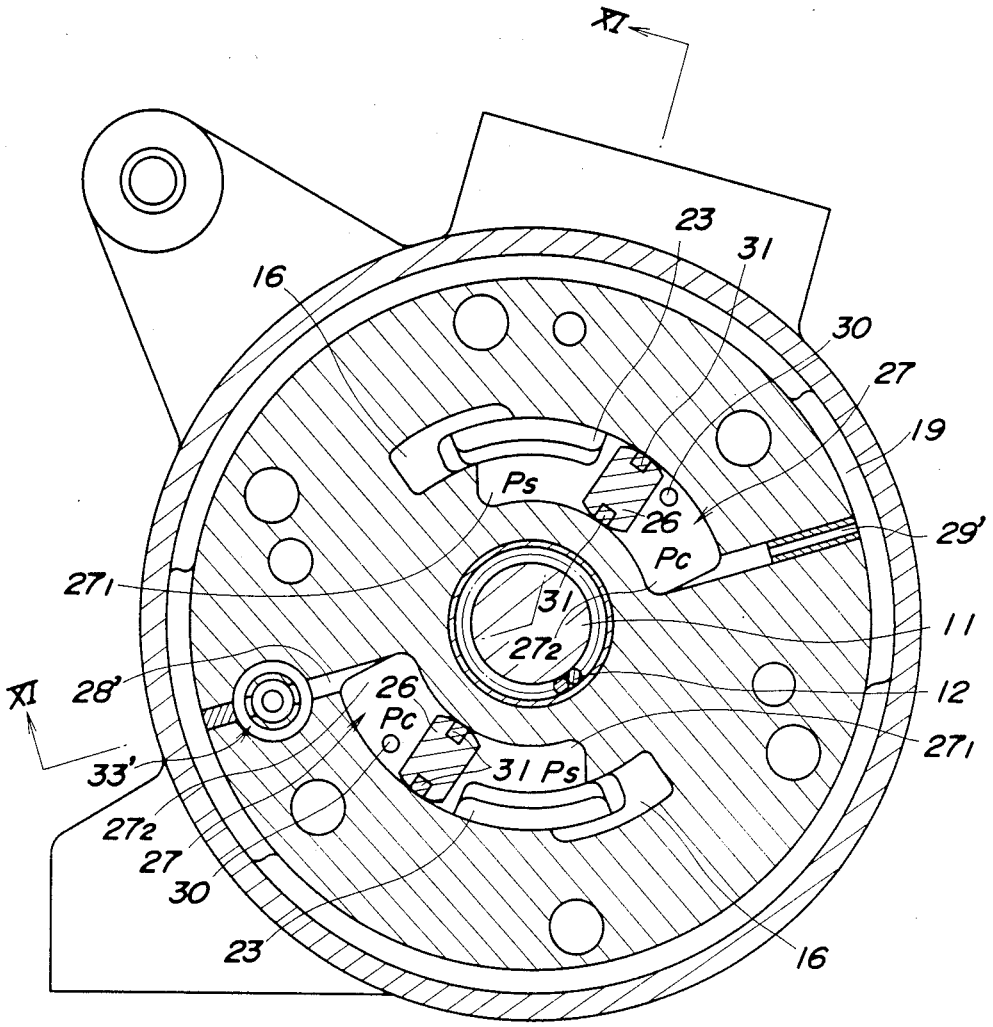
FIG. 15 is a sectional view taken along live XV—XV in FIG. 11.

On the other hand, when the pressure within the suction pressure chamber 17 is lower than the predetermined value, the bellows 34' is expanded to urge the ball valve body 48 away from the communication passage 46 through the valve rod 50 against the force of the coiled spring 49, thereby causing the ball valve body 48 to open the communication passage 46, as shown in FIG. 13. As a result, the pressure within the second chamber $27_2$ leaks into the suction chamber 17 through the communication passage 46 to angularly displace the control element 24 so that the cut-out portions 25 of the element 24 are registered with the respective second inlet ports 23, 23, thus fully opening the second inlet ports 23, 23. Therefore, the timing of commencement of the compression stroke is retarded by an amount corresponding to the degree of opening of the second inlet ports 23, 23, resulting in a reduced amount of refrigerant gas that is compressed and hence a reduced delivery quantity (Partial Capacity Operation).

If the bellows 34' becomes defective and the inside and outside of the bellows are brought into communication with each other, the bellows 34' becomes expanded to its maximum length by the increased internal pressure as well as the force of the coiled spring incorporated therein to thereby cause the tapered closing member 51 connected to the bellows 34' to close the communication passage 46 at the end facing the bellows 34'. As a result, the pressure within the second pressure chamber $27_2$ does not leak into the suction chamber 17 through the communication passage 46, whereby the second inlet ports 23, 23 are fully closed by the control element 24, thus resulting in the maximum delivery quantity (Full Capacity Operation).

What is claimed is:

1. A vane compressor comprising: a zone under low pressure; valve means having a deformable member disposed within said zone under low pressure for expansion and contraction in response to pressure prevailing within said zone under low pressure, and a valve body connected to said deformable means for displacement in response to expansion and contraction of said deformable means; pressure-responsive control means associated with said valve means for controlling the capacity of said compressor in response to displacement of said valve body; wherein said deformable means contracts and displaces said valve body to cause said control means to bring said compressor into full-capacity operation when the pressure within said zone under low pressure is higher than a predetermined value, whereas said deformable means expands and displaces said valve body to cause said control means to bring said compressor into partial-capacity operation when the pressure within said zone under low pressure is lower than said predetermined value; and means operable in response to to excessive expansion of said deformable means for causing said control means to bring said compressor into full-capacity operation.

2. A vane compressor as claimed in claim 1, wherein said deformable means comprises a bellows.

3. A vane compressor as claimed in claim 1, wherein said pressure-responsive control means comprises a first communication passage communicating with said zone under low pressure, and a second communication passage communicating with a zone under high pressure, and pressure-responsive means operable in response to pressures from said first and second communication passages for changing the capacity of said compressor, said valve body of said valve means comprising a spool valve arranged for selectively opening and closing said first and second communication passages, said means for causing said control means to bring said compressor into full-capacity operation comprising an annular groove formed in said spool valve for opening a predetermined one of said first and second communication passages.

4. A vane compressor as claimed in claim 3, wherein said deformable means comprises a bellows.

5. A vane compressor as claimed in claim 1, wherein said pressure-responsive control means comprises a first communication passage communicating with said zone under low pressure and a second communication passage communicating with a zone under high pressure, and pressure-responsive means operable in response to pressures from said first and second communication passages for changing the capacity of said compressor, said valve body of said valve means comprising a spool valve arranged for selectively opening and closing said first and second communication passages, said means for causing said control means to bring said compressor into full-capacity operation comprising urging means for forcing said spool valve to open a predetermined one of said first and second communication passages.

6. A vane compressor as claimed in claim 5, wherein said deformable means comprises a bellows.

7. A vane compressor as claimed in claimed 5, wherein said urging means comprises an electric motor and a rod driven by said electric motor for displacing said spool valve body.

8. A vane compressor as claimed in claim 7, wherein said deformable means comprises a bellows.

9. A vane compressor as claimed in claim 1, wherein said pressure-responsive control means comprises a first communication passage communicating with said zone under low pressure and a second communication passage communicating with a zone under high pressure, and pressure-responsive means operable in response to pressures from said first and second communication passages for changing the capacity of said compressor, said valve body of said valve means comprising a spool value arranged for opening and closing a predetermined one of said first and second communication passages, said means for causing said control means to bring said compressor into full-capacity operation comprising closing means connected to said deformable means for closing said predetermined one of said first and second communication passages during excessive expansion of said deformable means.

10. A vane compressor as claimed in claim 9, wherein said deformable means comprises a bellows.

11. A vane compressor as claimed in claim 9, wherein said valve means includes a ball valve as said valve body, and a rod connected to said deformable means for urging said valve body in a direction of opening said predetermined one of said first and second communication passages, said closing means comprising a tapered body formed integrally with said rod.

12. A vane compressor as claimed in claim 11, wherein said deformable means comprises a bellows.

* * * * *

UNITED STATES PATENT AND TRADEMARK OFFICE

CERTIFICATE OF CORRECTION

PATENT NO. : 4,850,815

DATED : July 25, 1989

INVENTOR(S) : Nakajima et al

It is certified that error appears in the above-identified patent and that said Letters Patent is hereby corrected as shown below:

In the title page, under "U.S. PATENT DOCUMENTS", the third reference "4,7373,081" should read

-- 4,737,081 --.

Signed and Sealed this

Seventh Day of August, 1990

*Attest:*

HARRY F. MANBECK, JR.

*Attesting Officer*

*Commissioner of Patents and Trademarks*